US007263317B2

(12) United States Patent
Kubota et al.

(10) Patent No.: US 7,263,317 B2
(45) Date of Patent: Aug. 28, 2007

(54) PARTICLE DISCHARGE APPARATUS AND IMAGE FORMING APPARATUS

(75) Inventors: Hiroshi Kubota, Osaka (JP); Yasuyuki Ishiguro, Osaka (JP); Yoshio Sakagawa, Hyogo (JP); Takeshi Takayama, Nara (JP); Jun Yamaguchi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 216 days.

(21) Appl. No.: 11/079,185

(22) Filed: Mar. 15, 2005

(65) Prior Publication Data

US 2005/0207795 A1 Sep. 22, 2005

(30) Foreign Application Priority Data

Mar. 17, 2004 (JP) ..... 2004-076709

(51) Int. Cl.
*G03G 15/08* (2006.01)

(52) U.S. Cl. ..... 399/258

(58) Field of Classification Search ..... 399/258, 399/259–262

See application file for complete search history.

(56) References Cited

U.S. PATENT DOCUMENTS 4,937,625 A * 6/1990 Kato et al. ..... 399/258
5,264,900 A * 11/1993 Momiyama et al. ..... 399/256
7,039,344 B2 * 5/2006 Nishiyama ..... 399/254
2004/0086301 A1 * 5/2004 Tamura ..... 399/227

FOREIGN PATENT DOCUMENTS

JP 2000-56567 2/2000
JP 2000-98722 4/2000
JP 2000-315007 11/2000
JP 2002040810 A * 2/2002
JP 2002-278244 9/2002

* cited by examiner

*Primary Examiner*—David M. Gray
*Assistant Examiner*—Ryan Gleitz
(74) *Attorney, Agent, or Firm*—Nixon & Vanderhye, P.C.

(57) ABSTRACT

A particle discharge apparatus includes cylindrical particle discharge unit(s) having toner dispensing outlet(s) provided at upper portion(s) on one side of particle discharge unit(s), and particle discharge outlet(s) provided at lower portion(s) on the other side of particle discharge unit(s); and conveyor screw(s), provided at the interior of particle discharge unit(s), having rotatable shaft(s) and helical conveyor vane(s) secured to rotatable shaft(s). The conveyor vane(s) is/are divided into first vane segment(s) and second vane segment(s); and wherein there is/are vaneless region(s), where no portion of conveyor vane(s) is present, between first vane segment(s) and second vane segment(s).

14 Claims, 5 Drawing Sheets

PARTICLE DISCHARGE APPARATUS AND IMAGE FORMING APPARATUS

BACKGROUND OF INVENTION

This application claims priority under 35 USC 119(a) to Patent Application No. 2004-76709 filed in Japan on 17 Mar. 2004, the content of which is hereby incorporated herein by reference in its entirety.

I. Field of Technology

The present invention relates to a particle discharge apparatus which discharges particles; more particularly, the present invention pertains to a particle discharge apparatus capable of being used with toner cartridge(s) or the like supplying developer (toner) to development apparatus(es) in copier(s) and/or other such electrophotographic image forming apparatus(es), and also pertains to an image forming apparatus employing such particle discharge apparatus(es).

II. Related Art and Other Considerations

Conventional image forming apparatuses employ finely toner particles as a developer. Toner cartridges removably installed on development apparatuses are used to supply such toner to internal development apparatuses.

As shown in FIG. 5, such a toner cartridge might be equipped with a cylindrical toner particle discharge unit 102 arranged horizontally, by way of toner dispensing outlet 101*a*, beneath cartridge main body 101, which contains the toner. Toner particle discharge unit 102 is provided with toner particle discharge outlet 103 at the bottom circumferential surface thereof. Furthermore, provided at toner dispensing outlet 101*a* is toner supply roller 101*b*, which, when driven, serves to quantitatively supply toner from the interior of cartridge main body 101 to toner particle discharge unit 102. Roller 101*b* is formed from sponge or the like which, when toner supply roller 101*b* is stopped, presses against toner dispensing outlet 101*a* so as to prevent toner from pouring out from toner particle discharge outlet 103.

Provided at the interior of toner particle discharge unit 102 is conveyor screw 105. Conveyor screw 105 comprises rotatable shaft 106, and conveyor vane 107 which is secured to this rotatable shaft 106 and which is formed in helically continuous fashion. Furthermore, mounted on toner particle discharge unit 102 so as to cover the outside circumferential surface thereof is cylindrical shutter cap 110. This shutter cap 110 is disposed so as to permit sliding axially relative to toner particle discharge unit 102. Moreover, when shutter cap 110 is made to overcome an elastic force from thrust spring 120 which is fitted onto the outside of toner particle discharge unit 102 and is made to slide in one direction X1, causing opening 111 formed in shutter cap 110 to line up with the toner particle discharge outlet 103 and open toner particle discharge outlet 103, toner can be supplied to the interior of a development apparatus, not shown, which is arranged beneath toner particle discharge unit 102.

With a toner cartridge constructed in such fashion, when there is no longer any toner present within the cartridge main body, the toner cartridge is removed from the development apparatus main body and filled with toner, following which it is again loaded into the development apparatus main body. In such case, to prevent leakage from toner particle discharge outlet 103 of toner remaining within the cartridge main body when the toner cartridge is removed from the development apparatus main body, the restoring force from thrust spring 120 causes shutter cap 110 to slide in the other direction X2 so as to close toner particle discharge outlet 103 (see, e.g., Japanese Patent Application Publication Kokai No. 2000-98722).

However, with conventional toner cartridges such as have been described above, as there will be toner which collects and remains present all the way along conveyor vane 107 when conveyor vane 107 of conveyor screw 105 (provided within toner particle discharge unit 101) is not being driven in rotational fashion. Air trapped within the toner can problematically the internal pressure of the toner which has collected thereat to increase at such time. This internal pressure causes the toner which has collected thereat to pour out in extruded fashion from toner particle discharge outlet 103.

An object of the present technology is to provide a particle discharge apparatus employing stratagem(s) to reduce internal pressure(s) within particle discharge unit(s) when conveyor vane(s) is/are not driven in rotational fashion, so as to make it possible to definitively prevent toner which has collected thereat from pouring out therefrom, and to provide an image forming apparatus employing such particle discharge apparatus(es).

BRIEF SUMMARY

A particle discharge apparatus in accordance with one or more example embodiments comprises one or more cylindrical particle discharge units having one or more particle dispensing outlets provided at one or more upper portions on one side of at least one of the particle discharge unit or units, and one or more particle discharge outlets provided at one or more lower portions on the other side of at least one of the particle discharge unit or units; and one or more conveyor screws, provided at the interior of at least one of the particle discharge unit or units, having one or more rotatable shafts and one or more helical conveyor vanes secured to at least one of the rotatable shaft or shafts; wherein at least one of the conveyor vane or vanes is divided, along at least one axis of at least one of the rotatable shaft or shafts, into a plurality of vane segments; and wherein there is at least one vaneless region, where no portion of the conveyor vane or vanes is present, between at least any two adjacent vane segments of the plurality of vane segments. More specifically, at least one of the conveyor vane or vanes may be divided into a first vane segment and a second vane segment; and there may be at least one vaneless region, where no portion of the conveyor vane or vanes is present, between the first vane segment and the second vane segment. Because embodiment(s) of the particle discharge apparatus of the present invention having such feature(s) permit existence of location(s) for particles to collect in vaneless region(s) between first vane segment(s) and second vane segment(s), and because air mixed together with particles at such location(s) is more easily freed therefrom, it is possible to prevent occurrence of problematic situations in which internal pressure due to trapped air causes toner which has collected thereat to pour out in extruded fashion from particle discharge outlet(s).

In such case, in the foregoing constitution, the first vane segment may be arranged so as to oppose at least one of the particle dispensing outlet or outlets; the second vane segment may be arranged so as to oppose at least one of the particle discharge outlet or outlets; and at least one of the vaneless region or regions may be disposed at a location not facing at least one of the particle dispensing outlet or outlets and not facing at least one of the particle discharge outlet or outlets.

Furthermore, a particle discharge apparatus in accordance with one or more embodiments of the present invention is such that one side of at least one cylindrical particle discharge unit is attached, by way of at least one intervening particle dispensing outlet, to at least one lower portion of at least one container containing particles, and is such that the particle discharge apparatus comprises one or more particle discharge outlets provided at at least one lower portion on the other side of at least one of the particle discharge unit or units; one or more particle supply rollers, provided at at least one of the particle dispensing outlet or outlets, for quantitatively supplying particles from at least one of the container or containers to the interior of at least one of the particle discharge unit or units; and one or more conveyor screws, provided at the interior of at least one of the particle discharge unit or units, having one or more rotatable shafts and one or more helical conveyor vanes secured to at least one of the rotatable shaft or shafts; wherein at least one of the conveyor vane or vanes is divided into a first vane segment and a second vane segment; wherein there is at least one vaneless region, where no portion of the conveyor vane or vanes is present, between the first vane segment and the second vane segment; and wherein there is at least one rollerless region, where no portion of the particle supply roller or rollers is present, at at least one of the particle dispensing outlet or outlets. Because embodiment(s) of the particle discharge apparatus of the present invention having such feature(s) permit existence of location(s) for particles to collect in vaneless region(s) between first vane segment(s) and second vane segment(s), and because air mixed together with particles at such location(s) is more easily freed therefrom, it is possible to prevent occurrence of problematic situations in which internal pressure due to trapped air causes toner which has collected thereat to pour out in extruded fashion from particle discharge outlet(s). This makes it possible for there to be rollerless region(s) at particle dispensing outlet(s), rollerless region(s) being location(s) where there is no portion of particle supply roller(s), which, when driven, serve to quantitatively deliver particles from container(s) to particle discharge unit(s), and which, when stopped, press against particle dispensing outlet(s) so as to prevent particles from pouring out from particle discharge outlet(s). Accordingly, it is possible to employ a simple construction wherein no portion of particle supply roller(s) is present at particle dispensing outlet(s). Furthermore, where foam roller(s) is/are employed as particle supply roller(s), the foregoing feature(s) will make it possible to prevent occurrence of failure due to impregnation of the foam interior by toner, i.e., particles, and subsequent hardening thereof.

Moreover, particle discharge apparatus(es) having the foregoing constitution(s) may be favorably employed in image forming apparatus(es) equipped with developer transport mechanism(s) and/or waste developer recovery mechanism(s) transporting developer in the form of particles having small particle size and/or high pigment content.

BRIEF DESCRIPTION OF DRAWINGS

FIG. 4(*b*) is a partial enlarged bottom view showing positional relationship between toner particle discharge unit and shutter cap when the toner cartridge is removed from the development apparatus main body.

DESCRIPTION OF PREFERRED EMBODIMENTS

Description of Overall Image Forming Apparatus

Figure 1:
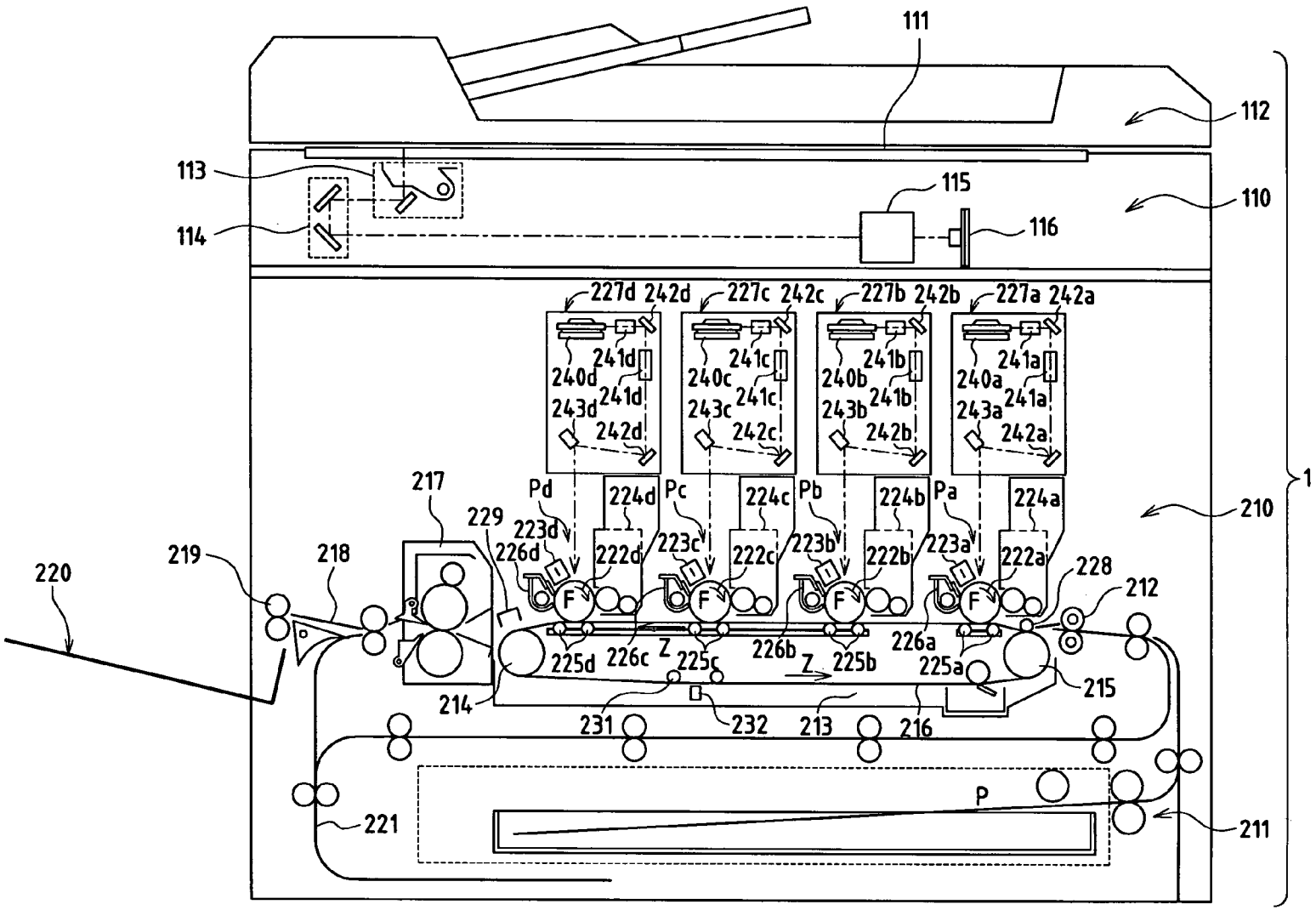
FIG. 1 is a schematic sectional diagram showing a digital color copier associated with an example embodiment.

FIG. 1 is a schematic sectional diagram showing a digital color copier (hereinafter simply "copier") 1 serving as color image forming apparatus associated with the present embodiment. This copier 1 comprises a reversing automatic document feeder (RADF) 112, image capturing unit 110, and image forming unit 210.

Provided at the top of the main body of copier 1 are original stage 111 and a control panel, described below. Furthermore, reversing automatic document feeder 112 is supported above original stage 111 so as to permit opening and closing thereof relative to this original stage 111.

Reversing automatic document feeder 112 first transports an original so as to cause one side of the original to oppose image capturing unit 110 at a prescribed location on original stage 111. Moreover, after the one side thereof has been subjected to image capture, the original is flipped and is transported toward original stage 111 so as to cause the other side thereof to oppose image capturing unit 110 at the prescribed location on original stage 111. Moreover, after both sides of an original have been subjected to image capture, reversing automatic document feeder 112 discharges this original and carries out double-sided transport operations on the next original. Such operations for original transport and flipping so as to reverse front and back sides thereof are controlled in coordination with overall operations at copier 1.

Image capturing unit 110 is arranged beneath original stage 111 for the purpose of capturing images of originals transported thereto above original stage 111 by reversing automatic document feeder 112. This image capturing unit 110 has original scanning bodies 113, 114 which move in reciprocating fashion parallel to the lower surface of this original stage 111; optical lens 115; and CCD line sensor 116 which is an optical-to-electrical conversion element.

Original scanning bodies 113, 114 comprise first scanning unit 113 and second scanning unit 114. First scanning unit 113 has an exposing lamp which exposes the original image surface; and a first mirror which reflects toward a prescribed direction the image formed by the light reflected from the original. Moreover, this first scanning unit 113 is controlled so as to move in reciprocating fashion at a prescribed scanning speed parallel to the lower surface of original stage 111 while maintaining a constant distance therefrom.

Second scanning unit 114 has a second and a third mirror which further reflect toward a prescribed direction the image formed by the light reflected from the original that has been reflected by the first mirror of first scanning unit 113. This second scanning unit 114 is controlled so as to move in reciprocating fashion parallel to and so as to maintain a constant relative speed with respect to first scanning unit 113.

Optical lens 115 reduces the image formed by the light reflected from the original that has been reflected by the third mirror of second scanning unit 114, the reduced optical image being formed at a prescribed location on CCD line sensor 116. This optical lens 115 may, for example, comprise a plurality of lens groups.

CCD line sensor 116 sequentially carries out optical-to-electrical conversion of the optical image which is formed thereon, outputting this as an electrical signal. This CCD line sensor 116 might, for example, comprise a trilinear color CCD capable of reading a black-and-white image or a color image, and of outputting line scan data wherein colors are separated into respective R (red), G (green), and B (blue) color components. Original image information converted into an electrical signal by this CCD line sensor 116 is, furthermore, transferred to an image processing unit (not shown), where prescribed image data processing is carried out thereon.

Next, constitution of image forming unit 210, and constitution of respective components associated with image forming unit 210, will be described. Provided below image forming unit 210 is paper supply mechanism 211 which separates paper (recording medium/media) P one sheet at a time from where it is stacked within a paper tray and which supplies same toward image forming unit 210. In addition, after having been separated and supplied one sheet at a time, paper P is transported to image forming unit 210, the timing with which this occurs being controlled by a pair of registration rollers 212 arranged at the near side of image forming unit 210. Moreover, after image formation has been carried out on one side thereof, paper P is again supplied and transported to image forming unit 210, the timing with which this occurs being coordinated with image formation at image forming unit 210.

Arranged below image forming unit 210 is transfer/transport belt mechanism 213. Transfer/transport belt mechanism 213 is constructed so as to transport paper P which is made to electrostatically cling to transfer/transport belt 216 suspended so as to extend in more or less parallel fashion between drive roller 214 and idler roller 215. In addition, provided adjacent to the region below transfer/transport belt 216 is an image pattern detection unit.

Moreover, arranged at a point downstream in the paper transport path from transfer/transport belt mechanism 213 is fuser apparatus 217 for fusing onto paper P the toner image which has been transferred and formed on paper P. After passing through the nip formed by a pair of fuser rollers at this fuser apparatus 217, paper P travels by way of switching gate 218, which switches transport direction, to discharge roller(s) 219, which discharge paper P onto discharge tray 220 attached to the outside wall of the main body of copier 1.

Switching gate 218 selectively switches the post-fusing transport path of paper P between a path for discharging paper P from the main body of copier 1, and a path for again supplying paper P toward image forming unit 210. When the transport direction of paper P has been switched by switching gate 218 such that paper P is again directed toward image forming unit 210, paper P is flipped so as to reverse front and back sides thereof by way of switchback transport path 221 and is thereafter again supplied to image forming unit 210.

Furthermore, above transfer/transport belt 216 in image forming unit 210 and near to transfer/transport belt 216 there are, arrayed in order from the upstream side of the paper transport path, first image forming station Pa, second image forming station Pb, third image forming station Pc, and fourth image forming station Pd. Drive roller 214 drives transfer/transport belt 216 in frictional fashion in the direction indicated by arrow Z at FIG. 1 so as to carry paper P, fed thereto via paper supply mechanism 211 as has been described, and sequentially transport paper P to image forming stations Pa through Pd.

Respective image forming stations Pa through Pd have substantially identical constitutions. Respective image forming stations Pa, Pb, Pc, Pd respectively comprise photosensitive drums (photosensitive bodies) 222*a* through 222*d* which are driven in rotational fashion in the direction indicated by arrow F at FIG. 1.

About respective photosensitive drums 222*a* through 222*d* there are, arranged in sequence in the direction of rotation of photosensitive drums 222*a* through 222*d*, charging units 223*a* through 223*d* which respectively uniformly charge photosensitive drums 222*a* through 222*d*; development apparatuses 224*a* through 224*d* which have toner cartridges and which respectively develop electrostatic latent images formed on photosensitive drums 222*a* through 222*d*; transfer electric discharge units 225*a* through 225*d* which transfer toner images developed on photosensitive drums 222*a* through 222*d* to paper P; and cleaning apparatuses 226*a* through 226*d* which remove residual toner from photosensitive drums 222*a* through 222*d*.

Furthermore, respectively provided above respective photosensitive drums 222*a* through 222*d* there are laser scanning units 227*a*, 227*b*, 227*c*, and 227*d*. Laser scanning units (exposure apparatuses) 227*a* through 227*d* comprise semiconductor laser device(s) (not shown) emitting light in the form of dots modulated in correspondence to image data; polygonal mirrors (deflection apparatuses) 240*a* through 240*d* for deflecting, in scan direction(s), laser beam(s) from the semiconductor laser device(s); fθ lenses 241*a* through 241*d* for imaging, onto the surfaces of photosensitive drums 222*a* through 222*d*, the laser beam(s) deflected by polygonal mirrors 240*a* through 240*d*; mirrors 242*a* through 242*d*, 243*a* through 243*d*; and so forth.

A pixel signal corresponding to the black image component of the color original image is input to laser scanning unit 227*a*; a pixel signal corresponding to the cyan image component of the color original image is input to laser scanning unit 227*b*; a pixel signal corresponding to the magenta image component of the color original image is input to laser scanning unit 227*c*; and a pixel signal corresponding to the yellow image component of the color original image is input to laser scanning unit 227*d*. Electrostatic latent images corresponding to original image information converted into colors in this fashion are formed on respective photosensitive drums 222*a* through 222*d*. In addition, development apparatus 224*a* contains black toner, development apparatus 224*b* contains cyan toner, development apparatus 224*c* contains magenta toner, and development apparatus 224*d* contains yellow toner; the electrostatic latent images on photosensitive drums 222*a* through 222*d* being developed by toner of these respective colors. This makes it possible to reproduce, as toner images of respective colors, the original image information which has been converted into colors at image forming unit 210.

Furthermore, provided between first image forming station Pa and paper supply mechanism 211 is paper handling charging unit 228. This paper handling charging unit 228 charges the surface of transfer/transport belt 216. As a result of having been charged by this paper handling charging unit 228, paper P, which is supplied thereto by paper supply mechanism 211, clings definitively to transfer/transport belt 216, in which state paper P is transported without undergoing shifting of position as it goes between first image forming station Pa and fourth image forming station Pd.

Moreover, provided at a region between fourth image forming station Pd and fuser apparatus 217, in a region almost directly above drive roller 214, is charge removal unit 229. An AC current, for separating from transfer/transport belt 216 the paper P which clings electrostatically to transfer/transport belt 216, is applied to this charge removal unit 229.

Cut-sheet paper stock may be used as paper P in the digital color copier constituted as described above. When this paper P is fed from an automatic-feed cassette and is supplied through guide(s) in the paper supply transport path of paper supply mechanism 211, the lead edge portion of this paper P is detected by sensor(s) (not shown), transport thereof being temporarily stopped by registration roller pair 212 based on detection signal(s) output by such sensor(s). Moreover, in coordination with the timing of operations at respective image forming stations Pa through Pd, paper P is delivered onto transfer/transport belt 216, which rotates in the direction indicated by arrow Z at FIG. 1. At such time, because, as has been described, a prescribed charge is applied by paper handling charging unit 228 to transfer/transport belt 216, the force of this electrostatic attraction permits paper P to be transported in stable fashion as it passes through respective image forming stations Pa through Pd.

At respective image forming stations Pa through Pd, toner images of respective colors are respectively formed, transport being carried out so as to cause the toner images of respective colors to be mutually combined in superposed fashion on the support surface of paper P, which clings electrostatically to and is transported by transfer/transport belt 216. When image transfer at fourth image forming station Pd has been completed, a charge removal electric discharge unit causes paper P to separate from transfer/transport belt 216 in sequential fashion beginning with the lead edge portion thereof, following which paper P is guided to fuser apparatus 217. And finally, after the toner image has been fused thereon, paper P is discharged from a paper discharge outlet (not shown) onto discharge tray 220.

Note that, in the constitution described above, laser scanning units 227*a* through 227*d* carry out optical writing on photosensitive drums 222*a* through 222*d*, exposure being carried out through scanning of laser beam(s). In contrast hereto, it is possible to adopt a constitution in which, instead of laser scanning units, an optical write system (LED head(s)) comprising light emitting diode array(s) and imaging lens array(s) is employed. LED heads are smaller in size than laser scanning units, and because there are no moving parts they also excel in quietness. LED heads may therefore be favorably employed in tandem-type digital color copiers and other such image forming apparatuses requiring multiple optical write units.

Description of Toner Cartridge Portion of Development Apparatus Associated with Present Invention Toner particle discharge apparatuses in accordance with the present embodiment may be employed as toner cartridges supplying toner to respective development apparatuses 224*a* through 224*d* in copier 1 having constitution as described above.

Figure 2:
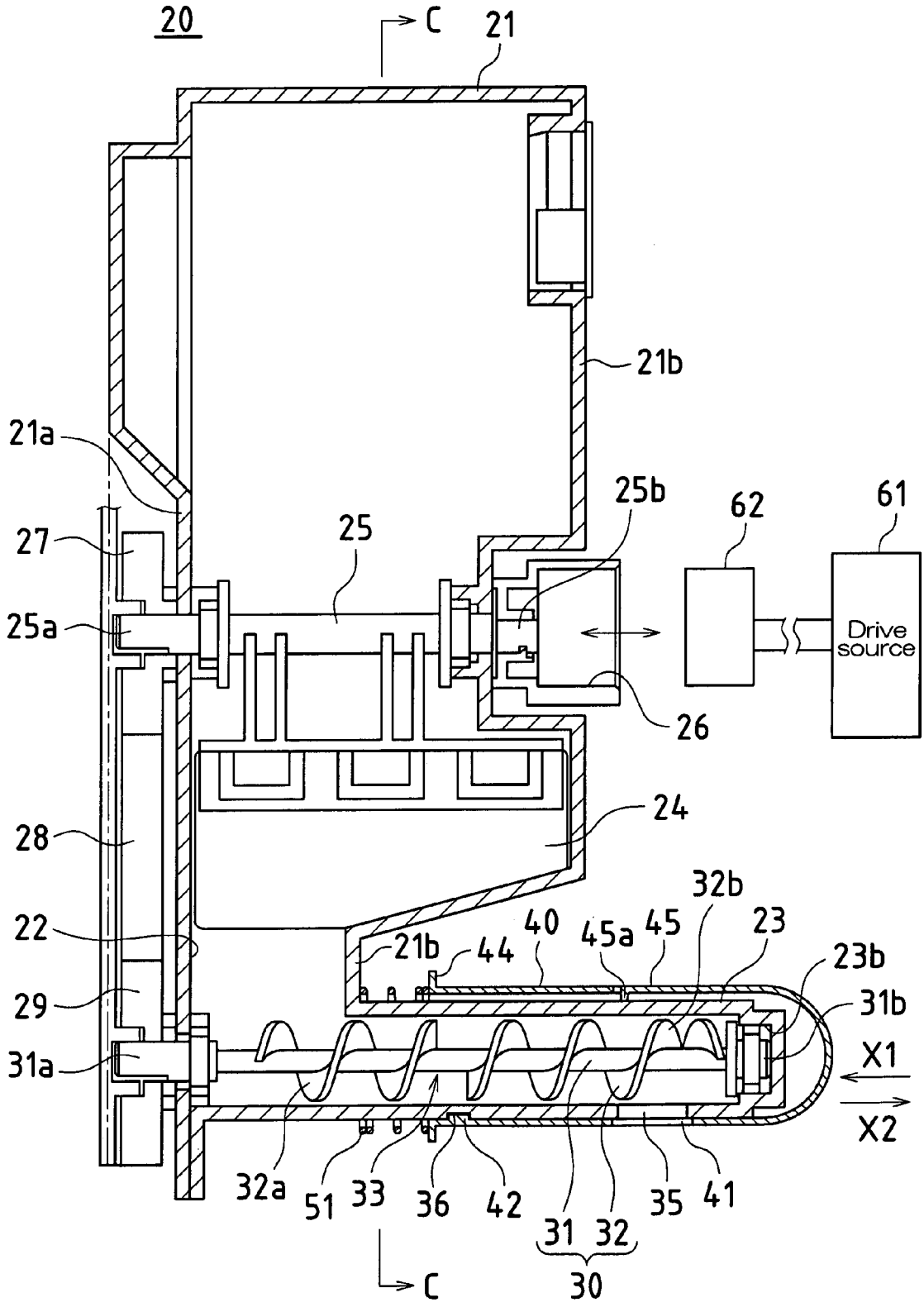
FIG. 2 is a schematic sectional diagram of a toner cartridge associated with the an example embodiment as viewed from the side.
Figure 3:
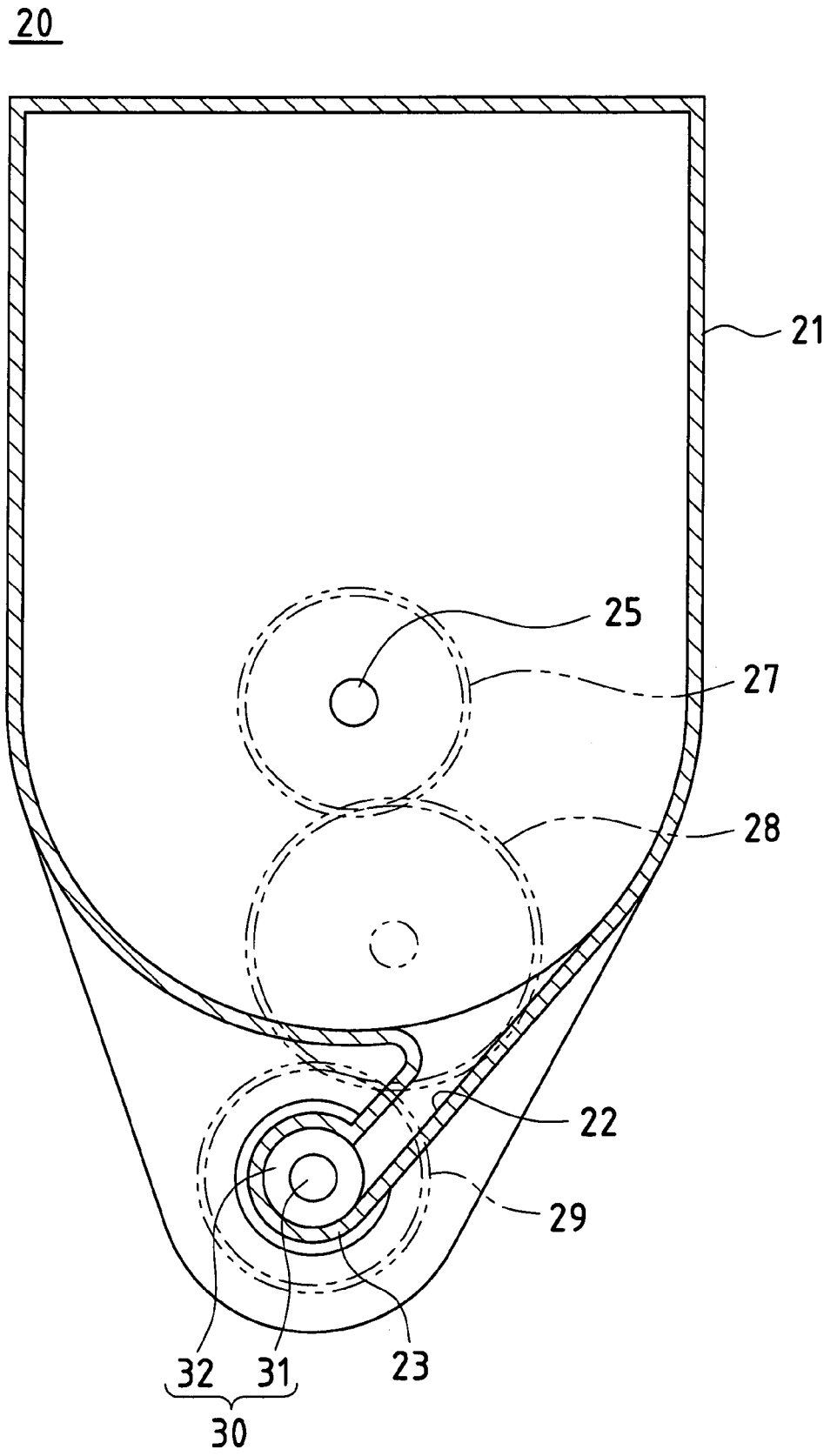
FIG. 3 is a schematic sectional view of section C-C shown in FIG. 2.
Figure 4A:
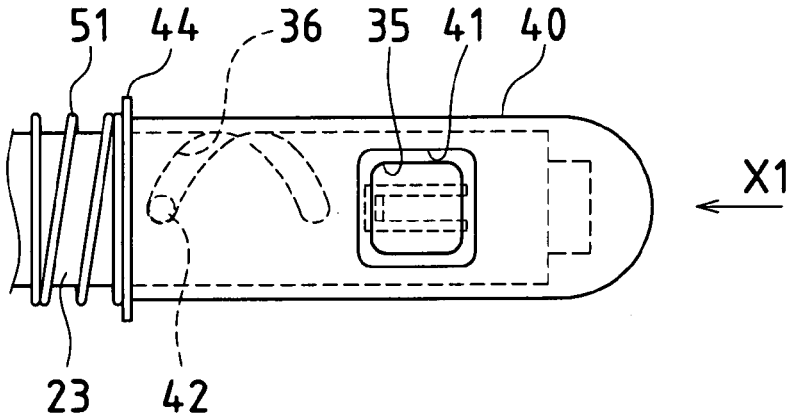
FIG. 4(*a*) is a partial enlarged bottom view showing positional relationship between toner particle discharge unit and shutter cap when the toner cartridge is loaded in the development apparatus main body.
Figure 4B:
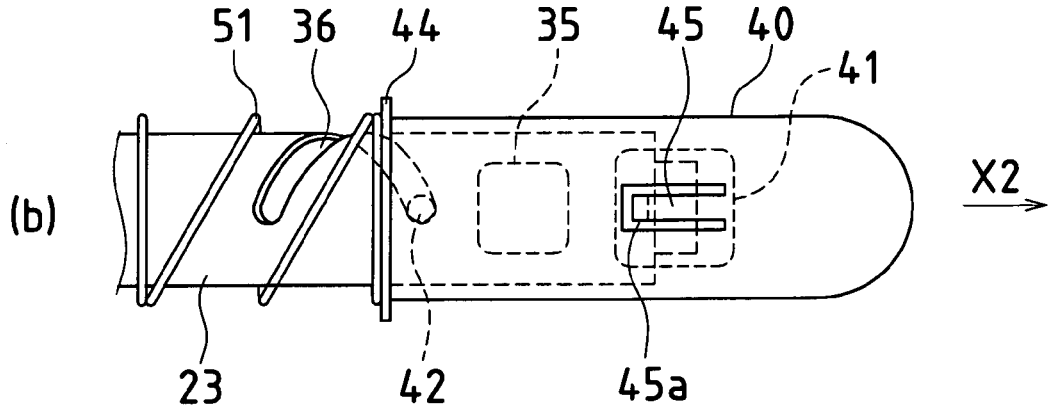

FIG. 2 is a schematic sectional diagram of the toner cartridge of the present embodiment as viewed from the side; FIG. 3 is a schematic sectional view of section C-C shown in FIG. 2; FIG. 4 is a bottom view of a toner particle discharge unit.

This toner cartridge 20, primarily as shown in FIG. 2, is equipped with cartridge main body 21 containing toner, i.e., particles; moreover, provided below this cartridge main body 21, by way of intervening toner dispensing outlet 22, is cylindrical toner particle discharge unit 23 which is arranged horizontally. This toner cartridge 20 is removably installed in a development apparatus main body, not shown.

Provided within cartridge main body 21 in such fashion as to pass through the front and back sidewalls 21*a*, 21*b* of cartridge main body 21 is rotatable shaft 25, which supports agitator vane(s) 24 at the central portion thereof and which rotates. Moreover, female engagement gear 26, disengageably engaged with gear 62 which is linked to drive source 61, is provided at the back end 25*b* of rotatable shaft 25, which protrudes from back sidewall 21*b*. Engagement gear 26 and gear 62 linked to drive source 61 comprise a clutch mechanism transmitting drive force. Furthermore, first gear 27 is attached to the front end 25*a* of rotatable shaft 25, which protrudes from front sidewall 21*a*.

Moreover, arranged within cylindrical toner particle discharge unit 23 is conveyor screw 30, which has helical conveyor vane(s) 32 secured to rotatable shaft 31. Back end 31*b* of rotatable shaft 31 is rotatably supported so as to be captured by recess 23*b* formed at the interior surface at the tip of toner particle discharge unit 23; front end 31*a* thereof is rotatably supported so as to pass through front sidewall 21*a* of cartridge main body 21. Furthermore, third gear 29 is attached to the front end 31*a* of rotatable shaft 31, which protrudes from front sidewall 21*a*. Furthermore, second gear 28, which links this third gear 29 to the aforesaid first gear 27, is attached to front sidewall 21*a*. That is, drive force from drive source 61 is transmitted to conveyor screw 30 by way of rotatable shaft 25 of agitator vane(s) 24, and first through third gears 27 through 29.

Toner particle discharge unit 23 constituted in such fashion is provided with toner particle discharge outlet 35 at the bottom of the circumferential sidewall at the tip portion thereof. Furthermore, mounted on this toner particle discharge unit 23 so as to cover the outside circumferential surface thereof is cylindrical shutter cap 40.

Shutter cap 40 is provided with opening 41 on the circumferential sidewall thereof for opening and closing toner particle discharge outlet 35 of toner particle discharge unit 23, and this shutter cap 40 is disposed so as to be capable of moving in substantially parallel fashion with respect to axial direction X (X1, X2) of toner particle discharge unit 23 while rotating in helical fashion.

That is, as mechanism for achieving helical motion in the present embodiment, groove 36 is formed on the outside circumferential surface of toner particle discharge unit 23 so as to wrap halfway around toner particle discharge unit 23 in helical fashion. Formed on the inside circumferential surface of shutter cap 40 in opposition thereto is sliding projection 42 which mates with and slides within groove 36. This will make it possible to cause shutter cap 40 to smoothly engage in helical motion while restricting the amount of rotation to one-half of a revolution. By thus causing shutter cap 40 to move so as to describe the locus of a helix, it is possible to open or close shutter cap 40 with a single operation. Furthermore, it is possible to achieve a construction which is such that shutter cap 40 is not easily opened, even when an external force is inadvertently applied thereto from a particular direction (e.g., axial direction(s) X).

Furthermore, coil spring 51 is fitted onto the outside of toner particle discharge unit 23. Spring 51 is installed between wall 21*b* at the back of toner cartridge main body 21 and flange 44 formed at the edge of the opening at the front side of shutter cap 40. That is, the elastic reactive force from this spring 51 causes shutter cap 40 to be constantly acted upon by a restoring force in the direction indicated by arrow X2.

FIG. 2 and FIG. 4(*a*) show shutter cap 40 pressed thereinto in the direction indicated by arrow X1, with spring 51 in its compressed state, this being the state thereof when loaded into the development apparatus main body (not shown). That is, although not shown in the drawings, when toner cartridge 20 has been loaded into the development apparatus main body, shutter cap 40 abuts the frame portion (not shown) of the development apparatus main body—the state shown at FIG. 2 and FIG. 4(*a*) being the result when shutter cap 40 is pressed against the frame portion.

Furthermore, as shown at FIG. 2 and FIG. 4(*a*), the location of opening 41 provided on shutter cap 40 is set so as to cause opening 41 to line up with toner particle discharge outlet 35 of toner particle discharge unit 23 (i.e., so as to open toner particle discharge outlet 35) when shutter cap 40 is pressed thereinto in the direction indicated by arrow X1, with spring 51 in its compressed state.

On the other hand, when toner cartridge 20 is removed from the development apparatus main body, because pressure from the frame portion is released, the elastic force of coil spring 51, as shown at FIG. 4(*b*), causes shutter cap 40 to move in the direction indicated by arrow X2 for a distance determined by the restriction represented by groove 36 as it turns one-half of a revolution. At such time, as a result of having turned one-half of a revolution, opening 41 of shutter cap 40 is made to move from its bottom position to a top position opposite toner particle discharge outlet 35, and toner particle discharge unit 23 is closed off by the inner wall of shutter cap 40. Thus, because opening 41 of shutter cap 40 is disposed so as to be moved upward by the elastic force from spring 51 when toner cartridge 20 is removed from the development apparatus main body, it is possible to prevent the problematic situation in which toner adhering to the region surrounding opening 41 of shutter cap 40 falls therefrom, soiling the surrounding area.

In addition, in the present embodiment, pressure-applying ridge 45 is formed in c-shaped fashion by deforming a portion of the circumferential sidewall (the circumferential sidewall at the top in FIG. 2; the circumferential sidewall at the bottom at FIG. 4(*b*)) opposite from opening 41 of shutter cap 40. In addition, tip 45*a* of this pressure-applying ridge 45 is formed so as to protrude toward the interior of shutter cap 40. Shutter cap 40 is itself formed from material having elasticity. That is, as a result of the fact that tip 45*a* of pressure-applying ridge 45 presses against the outside circumferential surface of toner particle discharge unit 23, the elastic force which pressure-applying ridge 45 itself possesses acts so as to cause opening 41 to constantly come in intimate contact with the outside circumferential surface of toner particle discharge unit 23. As a result, toner will not leak from opening 41 of shutter cap 40 even when toner is trapped between the outer circumferential surface of toner particle discharge unit 23 and the inner circumferential surface of shutter cap 40 as a result of rotation of shutter cap 40 in helical fashion for one-half revolution. Furthermore, because pressure-applying ridge (restoring force delivery means) 45 for causing opening 41 of shutter cap 40 to come in intimate contact with the outside circumferential surface of toner particle discharge unit 23 is, in the present embodiment, formed in c-shaped fashion by deforming a portion of the circumferential sidewall of shutter cap 40, it is possible to simplify the structure of the restoring force delivery means itself, and it is furthermore possible to simplify assembly of shutter cap 40 with respect to toner particle discharge unit 23.

Note, however, that the restoring force delivery means is not limited to this sort of pressure-applying ridge 45, it being possible to attain a similar restoring force by, for example, forming a recess on the inner circumferential surface opposite opening 41 of shutter cap 40, and arranging a coil spring between the inner circumferential surface of shutter cap 40 and the outer circumferential surface of toner particle discharge unit 23 such that one end of this coil spring is captured within this recess.

As shown in FIG. 2, in the present embodiment, a toner cartridge having constitution as described above is such that conveyor vane 32 is divided into first vane segment 32*a* and second vane segment 32*b*; and vaneless region 33, at which the conveyor vane is absent, is provided between first vane segment 32*a* and second vane segment 32*b*.

First vane segment 32*a* is arranged so as to oppose toner particle dispensing outlet 22; second vane segment 32*b* is arranged so as to oppose toner particle discharge outlet 35; and vaneless region 33 is disposed centrally, at a location facing neither toner particle dispensing outlet 22 nor toner particle discharge outlet 35.

By thus providing vaneless region 33, at which the conveyor vane is absent, at the central portion of conveyor screw 30, it is possible to cause existence of a location for toner to collect in vaneless region 33 between first vane segment 32*a* and second vane segment 32*b*, and because air mixed together with toner at such location at which toner collects is more easily freed therefrom, it is possible to prevent occurrence of problematic situations in which internal pressure causes toner which has collected thereat to pour out in extruded fashion from toner particle discharge outlet 35.

Figure 5:
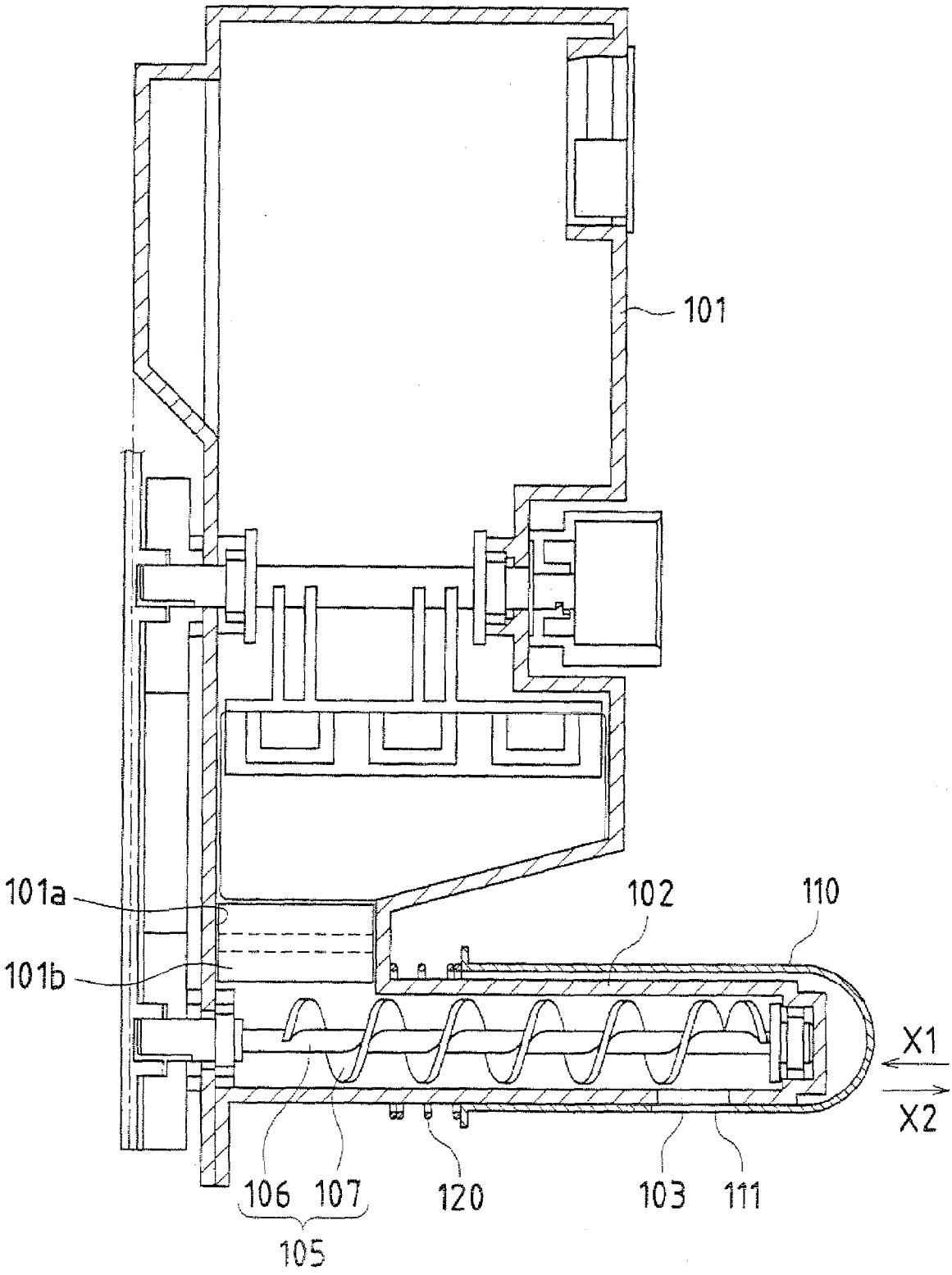
FIG.5 PRIOR ART
FIG. 5 is a schematic sectional diagram showing an example of the constitution of a conventional toner cartridge as viewed from the side.

This being the case, whereas the conventional toner cartridge shown in FIG. 5 is provided at toner dispensing outlet 101*a* with toner supply roller 101*b*, which, when driven, serves to quantitatively supply toner from where it is stored in toner cartridge main body 101 to toner particle discharge unit 102, and which, when stopped, presses against the toner particle dispensing outlet so as to prevent toner particles from pouring out from the toner discharge outlet. By contrast, the toner cartridge of the present embodiment may (as shown in FIG. 2) employ a simple construction in which there is no toner supply roller present at toner dispensing outlet 22. Furthermore, where a foam roller 101*b* is employed as the toner supply roller, the foregoing feature(s) will make it possible to prevent occurrence of failure due to impregnation of the foam interior by toner, i.e., particles, and subsequent hardening thereof.

Moreover, the present inventors have fabricated a prototype of a conveyor screw constituted as described above, and have carried out actual testing during which there was no toner supply roller present at the toner dispensing outlet. As a result, it was observed that toner which had collected within toner particle discharge unit 23 did not pour out from toner particle discharge outlet 35 when the conveyor screw was not being driven in rotational fashion.

Furthermore, whereas in the present embodiment the conveyor screw was divided into two parts, i.e., a first vane segment and a second vane segment; where the overall length of the conveyor screw permits, conveyor vane(s) may of course be divided into three or more parts. That is, a constitution may be adopted in which conveyor vane(s) is/are divided, along axis or axes of rotatable shaft(s), into three or more vane segments; and in which there is/are vaneless region(s), where no portion of conveyor vane(s) is present, between respective adjacent vane segments.

As described above, the particle discharge apparatus of the present invention may be favorably employed in transport mechanism units transporting developer or waste developer in electrophotographic copiers, printers, or other such image forming apparatuses.

Moreover, the present invention may be embodied in a wide variety of forms other than those presented herein without departing from the spirit or essential characteristics thereof. The foregoing embodiments and working examples, therefore, are in all respects merely illustrative and are not to be construed in limiting fashion. The scope of the present invention being as indicated by the claims, it is not to be constrained in any way whatsoever by the body of the specification. All modifications and changes within the range of equivalents of the claims are, moreover, within the scope of the present invention.

What is claimed is:

1. A toner particle discharge apparatus comprising:

one or more cylindrical toner particle discharge units having one or more toner particle dispensing outlets provided at one or more upper portions on one side of at least one of the toner particle discharge unit or units, and one or more toner particle discharge outlets provided at one or more lower portions on the other side of at least one of the toner particle discharge unit or units; and one or more conveyor screws, provided at the interior of at least one of the toner particle discharge unit or units, having one or more rotatable shafts and one or more helical conveyor vanes secured to at least one of the rotatable shaft or shafts;

wherein at least one of the conveyor vane or vanes is divided, along at least one axis of at least one of the rotatable shaft or shafts, into a plurality of vane segments; and wherein there is at least one vaneless region, where no portion of the conveyor vane or vanes is present, between any two adjacent vane segments of the plurality of vane segments, the vane segments adjacent to the vaneless region convey toner particles in the same direction.

2. A toner particle discharge apparatus according to claim 1 wherein:

at least one of the vaneless region or regions is disposed at a location not facing at least one of the toner particle dispensing outlet or outlets and not facing at least one of the toner particle discharge outlet or outlets.

3. A toner particle discharge apparatus according to claim 1 wherein at least a portion of the toner particles has small toner particle size and/or high pigment content.

4. An image forming apparatus employing at least one toner particle discharge apparatus according to claim 1.

5. A toner particle discharge apparatus according to claim 2 wherein at least a portion of the toner particles has small toner particle size and/or high pigment content.

6. An image forming apparatus employing at least one toner particle discharge apparatus according to claim 2.

7. A toner particle discharge apparatus comprising:

one or more cylindrical toner particle discharge units having one or more toner particle dispensing outlets provided at one or more upper portions on one side of at least one of the toner particle discharge unit or units, and one or more toner particle discharge outlets provided at one or more lower portions on the other side of at least one of the toner particle discharge unit or units; and one or more conveyor screws, provided at the interior of at least one of the toner particle discharge unit or units, having one or more rotatable shafts and one or more helical conveyor vanes secured to at least one of the rotatable shaft or shafts;

wherein at least one of the conveyor vane or vanes is divided into a first vane segment and a second vane segment; and wherein there is at least one vaneless region, where no portion of the conveyor vane or vanes is present, between the first vane segment and the second vane segment, the first vane segment and the second vane segment convey toner particles in the same direction.

8. A toner particle discharge apparatus according to claim 7 wherein:

the first vane segment is arranged so as to oppose at least one of the toner particle dispensing outlet or outlets; and the second vane segment is arranged so as to oppose at least one of the toner particle discharge outlet or outlets.

9. A toner particle discharge apparatus according to claim 7, wherein:

at least one of the vaneless region or regions is disposed at a location not facing at least one of the toner particle dispensing outlet or outlets and not facing at least one of the toner particle discharge outlet or outlets.

10. A toner particle discharge apparatus according to claim 9 wherein:

the first vane segment is arranged so as to oppose at least one of the toner particle dispensing outlet or outlets; and the second vane segment is arranged so as to oppose at least one of the toner particle discharge outlet or outlets.

11. A toner particle discharge apparatus according to claim 7 wherein at least a portion of the toner particles has small toner particle size and/or high pigment content.

12. An image forming apparatus employing at least one toner particle discharge apparatus according to claim 7.

13. A toner particle discharge apparatus according to claim 8 wherein at least a portion of the toner particles has small toner particle size and/or high pigment content.

14. An image forming apparatus employing at least one toner particle discharge apparatus according to claim 8.

* * * * *